US005133344A

United States Patent [19]

Jurrius et al.

[11] Patent Number: 5,133,344

[45] Date of Patent: Jul. 28, 1992

[54] INFLATABLE PROTECTIVE HOOD

[75] Inventors: Eran J. P. Jurrius, Medina; John S. Petro, IV, Tallmadge; Edward N. Taber, Burbank, all of Ohio

[73] Assignee: Environmental Safety First Industries, Inc., Mogadore, Ohio

[21] Appl. No.: 709,636

[22] Filed: Jun. 3, 1991

[51] Int. Cl.[5] ..... A62B 17/04

[52] U.S. Cl. ..... 128/201.23; 128/201.29

[58] Field of Search ..... 128/201.22, 201.23, 128/201.24, 201.25, 201.28, 201.29, 205.26

[56] References Cited

U.S. PATENT DOCUMENTS

| | | | |
|---|---|---|---|
| 2,529,106 | 11/1950 | Schauweker | 128/201.25 |
| 3,458,864 | 8/1969 | Austin et al. | 128/201.23 |
| 3,529,594 | 9/1970 | Charnley | 128/201.29 |
| 4,032,991 | 7/1977 | Vandeweghe | 128/201.25 |
| 4,055,173 | 10/1977 | Knab | 128/201.29 |
| 4,146,025 | 3/1979 | Warncke et al. | 128/201.23 |
| 4,411,264 | 10/1983 | Jacobson | 128/201.23 |
| 4,466,432 | 8/1984 | Wise | 128/201.23 |
| 4,484,575 | 11/1984 | Brockway et al. | 128/201.23 |
| 4,619,254 | 10/1986 | Moretti et al. | 128/201.23 |
| 4,768,235 | 9/1988 | Webster | 128/201.29 |
| 4,870,959 | 10/1989 | Reisman et al. | 128/201.25 |
| 4,889,113 | 12/1989 | Pelloux-Gervars et al. | 128/201.25 |
| 4,901,716 | 2/1990 | Stackhouse et al. | 128/201.28 |
| 5,003,973 | 4/1991 | Ford et al. | 128/201.25 |

*Primary Examiner*—Edgar S. Burr
*Assistant Examiner*—Aaron J. Lewis
*Attorney, Agent, or Firm*—Hudak & Shunk Co.

[57] ABSTRACT

A collapsible protective hood connectable to a source of air is suitable for use in clean rooms, for biological, nuclear, or hazardous material protection, and the like. The hood is generally made of a minimum number of panels which are electronically seam fused together without the use of any adhesive. The hood can optionally contain sleeves, optionally be of a long length, and optionally have a long interior flap. The inflatable collar, when inflated, generally supports the weight of the hood on the user's shoulders and preferably contains a plurality of air-breathing holes which provide air to the user. In another embodiment, the collar extends to above the user's head wherein air holes are provided and the slight pressure within the hood maintains it in an inflatable shape. The protective hood is made out of flexible non-woven material or woven material generally in the form of a laminate and can be readily collapsed in generally a flat shape for storage or transportation purposes.

24 Claims, 4 Drawing Sheets

INFLATABLE PROTECTIVE HOOD

FIELD OF THE INVENTION

This invention relates to an inflatable protective hood desirably connected to a source of air and is particularly useful for environmental work with undesirable compounds such as chemical, biological, nuclear, hazardous materials, and the like.

BACKGROUND OF THE INVENTION

U.S. Pat. No. 2,529,106 relates to a combined hood and respirator where the respirator device is externally connected to a hood comprising several fabric sectional panels stitched together.

U.S. Pat. No. 3,458,864 relates to a simple protective hood containing a front plastic window for vision purposes where the hood includes an outer skirt and an inner annular flap. The various parts of the fabric hood are sewn together.

U.S. Pat. No. 4,032,991 relates to a protection device containing an air-tight envelope made of fire resistant transparent sheet plastic material and encloses a premoistened porous face mask secured thereto. The device is rendered into the operative condition by opening the envelope which converts to a head cap for covering head and eyes of the wearer and extending the face mask out of the envelope whereby the mask extends downwardly from the cap over the nose and mouth of the wearer to afford protection against smoke and noxious fume inhalation.

U.S. Pat. No. 4,146,025 relates to a device for testing the tightness of fit of a gas mask which has a tubular respiratory air inlet and a tubular exhaling air outlet, which is applied over the face of a wearer, comprising a bag-like headpiece which is engageable over the wearer's head and is preferably made of a transparent material, such as plastic, and which is provided with an opening for the wearer's neck and an opening for the tubular air inlet of the gas mask with a resilient rim for tightly engaging these parts when the headpiece is positioned on the wearer's head.

Other air supplied hoods are shown in U.S. Pat. Nos. 4,411,264, and 4,466,432, where respirator air is supplied from an external source for breathing purposes.

U.S. Pat. No. 4,484,575 pertains to an air supplied respiratory hood containing a curved optical transparent lens. The hood is supported overhead by a forehead engaging board. Air under pressure is supplied to the interior of the hood through a neck engaging, permanently formed, tubular ruff having front apertures 46 for supplying air to the wearer (FIGS. 13 and 14). An annular elastic band is located within the preformed ruff to maintain intimate contact with the neck. The hood is further fitted with an annular collar 54 for interconnecting the hood structure with a protective suit.

U.S. Pat. No. 4,619,254, relates to a protective hood fitted with a respirator device where the hood includes a so-called ruff, comprising an annular rigid tube disposed approximate to the chin area which provides respirable air to a respirator means inside the hood.

U.S. Pat. No. 4,768,235, relates to a cold weather mask and hood made of a flexible insulating layered material which covers the wearer's entire head, shoulders and upper chest. A partially detachable face portion contains a lens receptacle which holds removable lends. An air intake hose provides warm, fresh air for inhalation, and an exhaust tube is used for exhalation. The exhaust tube contains ridges which hold the mask away from the lower face to form an air pocket.

In U.S. Pat. No. 4,870,959, a simple one-piece head mask is shown comprising a plastic enclosure for the head only and containing a filtered opening in the mouth area for breathing.

SUMMARY OF INVENTION

The protective hood of the present invention desirably is made from a minimum number of panels having adhesive-free seams and desirably contains an inflatable collar and/or air supply means. In one embodiment, the inflatable collar generally extends about the neck of the user so that it resides upon the shoulder and serves to support the hood when inflated. Such an embodiment eliminates the need for elastic bands, pulls, draw strings, and other fitting means. The hood is generally oversized such that it is large enough to accommodate a worker's hard hat, and/or audio communication equipment, and the like. The collar contains a plurality of air holes to provide breathing air to the user while the collar is inflatable. In another embodiment, the air supply means extends to a position above the head of the user and thus generally emits air in a downward direction. The hood is made out of a suitable material to provide it with excellent environmental protection against hazardous liquids and gases, nuclear material, biological compounds, chemical compounds, and the like. The hood can contain arms of any desirable length or be sleeveless and contain depending front or back body panels which can be short or can extend down as to about a user's waist. Interior panels of any desirable length can optionally be utilized which can fit under a user's shirt, blouse, etc.

The various seams connecting the panel forming the hood are adhesive free and are formed by fusing, such as by heat, by electronic seam fusing, or the like, to provide a solid, impervious connection. The hood is made out of various flexible materials and thus when not in use can have a generally flat shape for easy storage or transportation. The hood can include a flat and flexible visor or the visor can be preformed and curvilinear. These and other advantages of the invention will become apparent by referring to the drawings and to the detailed description of the invention.

BRIEF DESCRIPTION OF THE DRAWINGS

FIG. is a front elevation view of the protective hood of the present invention.

DETAILED DESCRIPTION OF THE INVENTION

Figure 2:
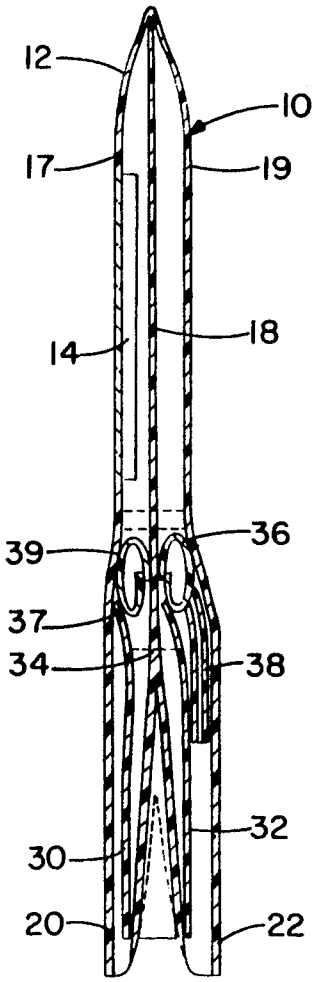
FIG. 2 is a side elevation view of the protective hood in FIG. 1 and particularly showing the protective hood in a collapsed state for storage and before use.

The inflatable protective hood of the present invention relates to an overhead section having front and back exterior panels depending therefrom. The panels are desirably integral with the overhead section although they can be separate therefrom, and can be of any length so as to fit over a user as from the shoulder area down to the waist or hip area or even lower. Optional interior panels generally fit inside a person's clothing, can extend from generally the neck area and depend downward to any desirable length. The protective hood can optionally contain sleeves of any length. Desirably, the hood contains an inflatable collar, free of any type of support, bracket, elastic bands, pull strings, and the like, having a plurality of air holes therein, such that air admitted to the collar from an external air supply source is then transferred into the overhead section of the hood. The inflatable support free collar generally is positioned about the neck and shoulder area and is located inside the exterior panel so that it supports the inflatable hood about a person's head. Since a constant source of air and/or oxygen is supplied to the inflatable collar and to the hood, excess air will generally flow downward about the collar and be exhausted underneath the exterior panels. The various panels of the hood are fused together as by heat, electronic seam fusing, and the like, so that no stitching and accompanying holes exist. Such seams are also free of any adhesive It should be apparent from the above brief description that a great many number of different embodiments are within the scope of the present invention with the following detailed description relating to of the preferred embodiments.

Referring now to the drawings wherein like reference characters designate like parts, shown is a protective hood 10 comprising an overhead section 12 having a plurality of depending protective sheets or flaps adapted to protect the shoulders and upper chest area of the user of the protective hood 10. The length of the exterior or interior panels as noted above, however, can independently extend from approximately the user's shoulders down to and about the user's waist, hips, or the like, depending upon the desired end use. As shown in the embodiments of FIGS. 1 through 4, the hood generally has no sleeves.

Figure 1:
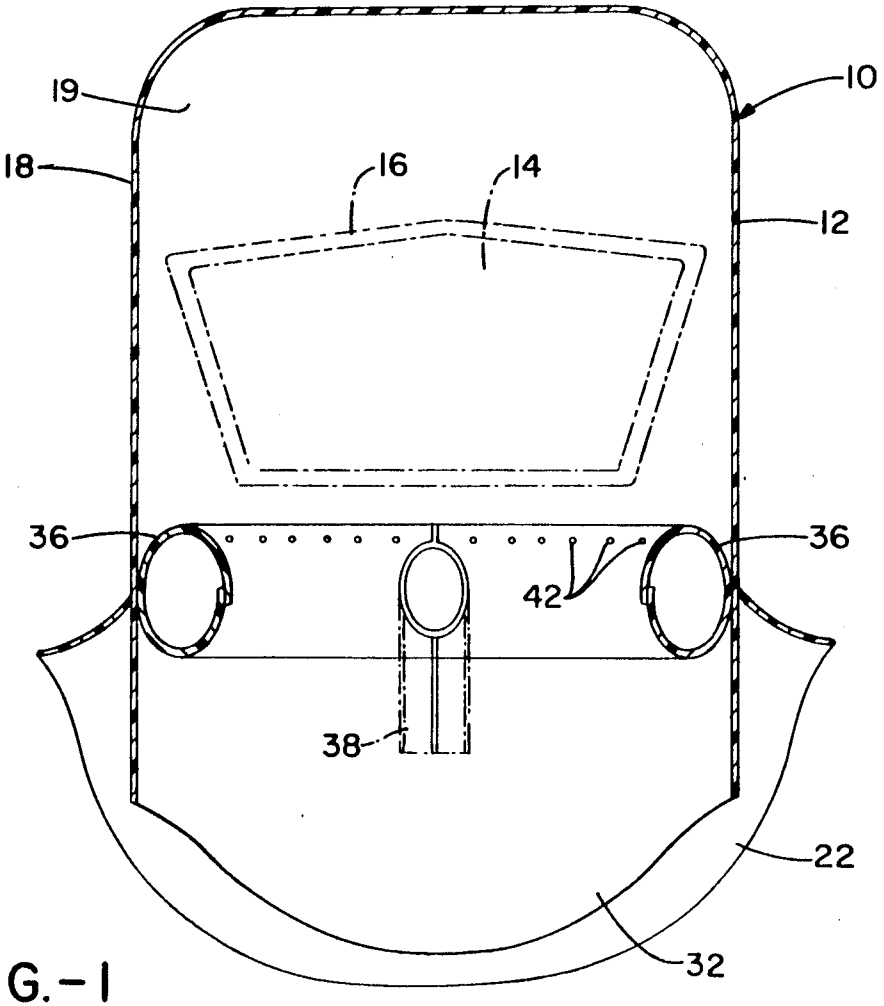
Figure 3:
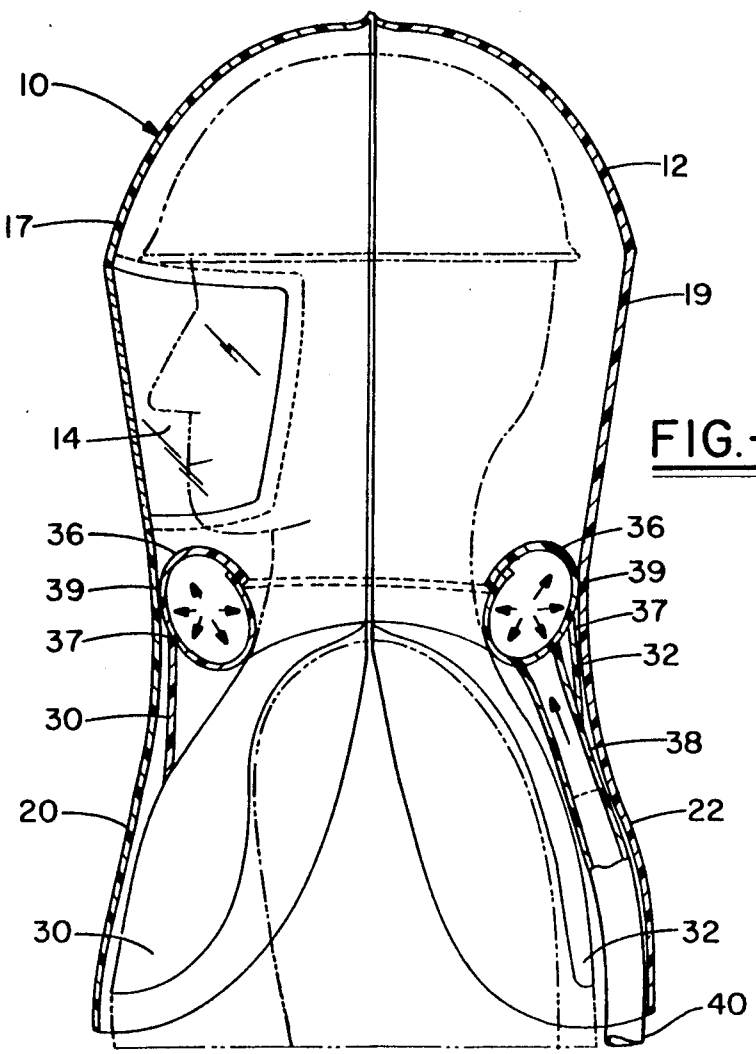
FIG. 3 is a side elevation view of the protective hood shown in FIGS. 1 and 2 in an expanded state while in use on a person wearing the hood.

In FIGS. 1 through 3, the overhead section 12 of the protective hood 10 comprises a front panel 17 and a back panel 19 secured together by a fused seam 18 along the top and side edges of the hood 10. The front panel contains a clear transparent plastic visor 14 secured and sealed peripherally at seam 16 to provide an impervious secure connection between the surrounding front panel 17 and the periphery of the visor 14. Although visor 14 can be optionally planar in the collapsed, non-use state as shown in FIG. 2, it is sufficiently flexible to bend and partially wrap around the face of the wearer as shown in FIG. 3. However, visor 14 preferably is preformed in an arcuate or curvilinear structure and the same is preferred in an embodiment where the wearer's head is free to move from side to side while the hood 10 remains stationary. In either embodiment, the visor 14 configuration can be rectangular, oval, elliptical, square or a similar convenient design.

Figure 3A:
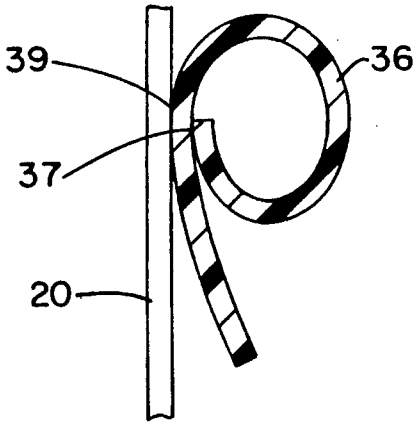
FIG. 3*a* is a partial cross-sectional view of FIG. 3 showing a collar being integral with an interior flap.

The overhead section 12 of the hood 10 is interconnected to an inflatable annular collar 36 which is further secured to downwardly depending inner flaps consisting of a front inner flap 30 and a rear inner flap 32 which are generally connected to the lower periphery of the collar 36. Preferably, the connections between the collar 36 and the inner flaps 30,32 is by a fused seam 37. The adjacent side edges of the front and rear inner flaps 30,32 are secured together by fused seam 34. Alternatively, as shown in FIG. 3*a*, the inner flaps 30,32 can comprise a continuous panel extending upwardly to form an integral collar 36 where the panel loops, extends downwardly, and then is secured to outer flaps 20,26 by fused seam 39.

The inner front and rear flaps 30,32, best viewed in FIGS. 2 and 3, are somewhat shorter in length than outer flaps 20,22. The outer flaps 20,22 are generally longer and intended to cover the exterior of the user's clothing in the shoulder, chest, and back area to protect the same from contact with undesirable environmental materials. The shorter interior flaps 30,32 are adapted to be worn inside the user's clothing and particularly tacked inside the collar and shoulder area of the user's shirt or jacket. The inner flaps 30,32 are intended to provide additional environment protection to the user.

The collar 36 comprises a continuous strip of flexible material and as noted above, is secured to overhead section 12 and specifically front and rear flaps 20 and 22 by fused seam 39. The collar 36 is adapted to rest flat against the flaps 20,22,30,32 in non-use (FIG. 2) but adapted to be inflated in use (oval shape) to surround the user's neck and rest on his shoulders, see FIG. 3. The inflated collar 36 provides vertical support for the overhead section 12 of the hood 10 whereby the weight of the hood 10, when inflated with air, i.e. positive pressure, is transferred to the inflated collar 36 rather than having the entire dead weight of the hood 10 supported by the user's head.

As best viewed in FIG. 3, the inflatable collar 36 contains a downwardly depending, rear air duct 38 communicating with the interior of the hollow inflatable collar 36 at the backside part of the collar 36. In use, the air duct 38 is adapted to be interconnected with an external air hose 40 further connected to a source of air or oxygen whereby the collar 36 can be inflated. The air duct 38 is disposed between the rear inner flap 32 and the rear outer flap 22. The air duct communicates with the inside of the collar 36 by an oval opening in the collar 36. The air duct 38 can be tied or clamped or otherwise secured to external hose 40.

In a preferred aspect of the invention, the inflatable collar 36 contains a plurality of laterally adjacent tiny air passage openings 42 communicating directly with the interior of the inflatable collar 36 and desirably are located angularly in the upper portion of the collar 36. The air openings 42 are particularly secured to the inside or internal wall of the collar 36, namely, the interior neck wall which will be located adjacent to the user's neck in use. The plurality of air openings 42 are preferably laterally disposed as at regular intervals in the circumferential dimension of the inflated collar 36 in the interior neck wall to enable air to pass from the inflated collar 36 to the neck side of the user and be readily available to the user for breathing purposes. In this preferred aspect of the invention, the auxiliary hose 40 is retained in connection with the rear air duct 38 in use where the external air source maintains sufficient positive pressure to maintain the collar 36 inflated while releasing sufficient air through the air openings 42 to provide adequate breathing air to the wearer of the hood 10.

Referring now to FIG. 2, the protective hood 10 is shown in a collapsed condition where front and back sections of the hood 10 are collapsed together to form a flat, substantially planar configuration which is particularly useful for storage or transportation. In this mode, the overhead section 12 comprising front and rear panels 17, 19, the inner flaps 30,32, the outer flaps 20,22, the inflatable collar 36, and the visor 14, are all in a flat collapsed state to form a unit typically having a collapsed thickness of less than one inch as from about one-quarter to one-half inch, or the like. Preferably, front overhead section 12 and exterior outer front flap 20 are integral and the rear overhead section is integral with rear or exterior flap 22. It is readily seen that the entire protective hood 10, including the visor 14, is free of preformed, non-flexible, bulky parts whereby the front section of the hood 10 can be collapsed completely flat onto the back section of the hood as shown in FIG. 2.

In FIG. 3, shown is a side elevation view of the protective hood 10 expanded in use to be larger than a hard hat worn by the user. It is seen that the normally planar visor 14 is sufficiently flexible to bend partly around the user's face in use to provide peripheral as well as straight ahead viewing and that a user can readily turn his head in the hood without having the hood turn. Moreover, the hood is adaptable to accommodate auxiliary equipment therein such as audio, radio receivers, and the like.

The seams between the various fabric sections comprise fused seams. For instance, a fused peripheral seam 18 secures the peripheral connection between the front panel 17 and the rear panel 19 of the overhead section of the hood 10. Such a fused seam 18 is impervious to undesirable environmental compounds and especially gasses. Other fused seams of the protective hood 10 include peripheral seam 16 joining visor 14 to front panel 12, fused seam 37 joining front and rear inner flaps 20 and 22 with collar 36, and fused seam 39 joining the inflatable collar 36 with front and rear outer flaps 20,22. The fused seams can be formed under heat and/or pressure, by electronic fusion, radio frequency heating, ultrasound melt welding, and the like.

Figure 4:
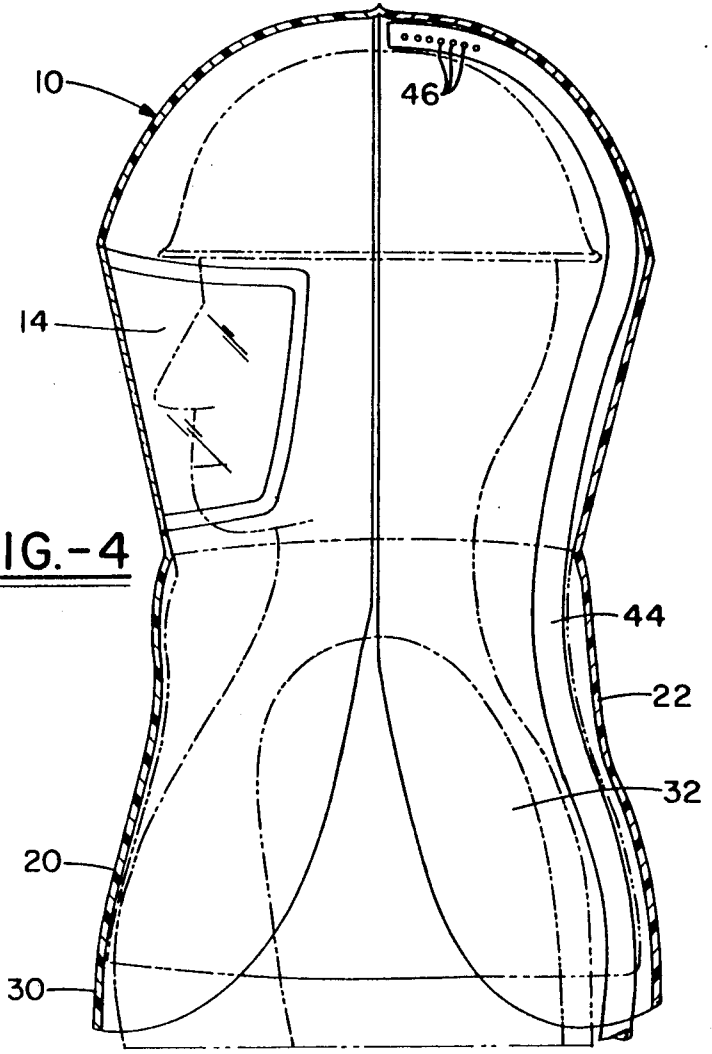
FIG. 4 is a side elevation view of another embodiment of the protective hood which does not contain a collar.

According to the embodiment of FIG. 4, a fused seam protective hood is provided and is generally very similar to the embodiment discussed hereinabove with regard to FIGS. 1 through 3 and hence the description thereof will not be repeated. Rather, the same is hereby fully incorporated by reference. However, the embodiment of FIG. 4 lacks an inflatable collar. Rather, air can be supplied in any conventional manner as through the utilization of hose 44 directed to the overhead section of the hood. That is, a hose connected to a source of air or oxygen extends up along generally the back portion of the hood and is fastened to the top thereof in any conventional manner and contains air-breathing holes 46 at the end thereof. The top end portion of the hose can simply be a hose as shown in FIG. 4 or it can be in the form of an inflatable hat having air holes spaced throughout directed towards the top of the person's head, or the exhaust means can be in the form of a halo, that is an annular tube generally located above the head of the user and also having air holes therein to direct the air in a downward manner. Thus, in use, the embodiment of FIG. 4 generally provides air to the portion above the user's head and thus inflates the hood and with the air generally flowing downwardly and exiting out along the body of the user. Alternatively, hood 10 may not contain any source of air thereto such as collar 36 or air hose 44 and thus the embodiment of FIG. 4 need not be inflatable and therefore need not contain an air hose. In such an embodiment, the hood will generally be supported by the head or the hard hat of the user.

Figure 5B:
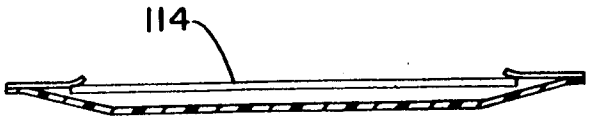
FIG. 5*b* is a cross-sectional view of the head portion of the protective hood showing a flap visor.
Figure 5C:
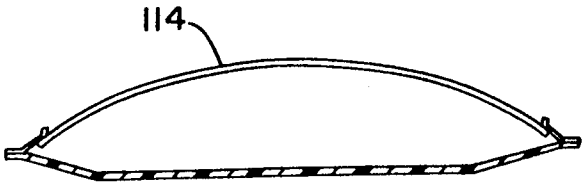
FIG. 5*c* is a cross-section view of the head portion of the protective hood showing a curvilinear visor.
Figure 5D:
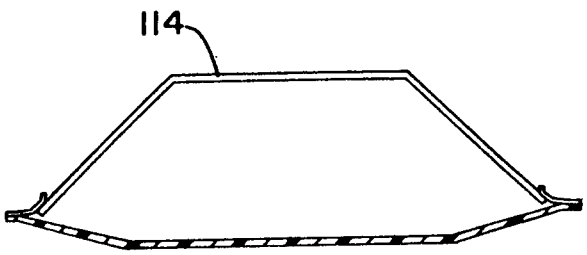
FIG. 5*d* is a cross-section view of the head portion of the protective hood showing a U-shaped visor.
Figure 5:
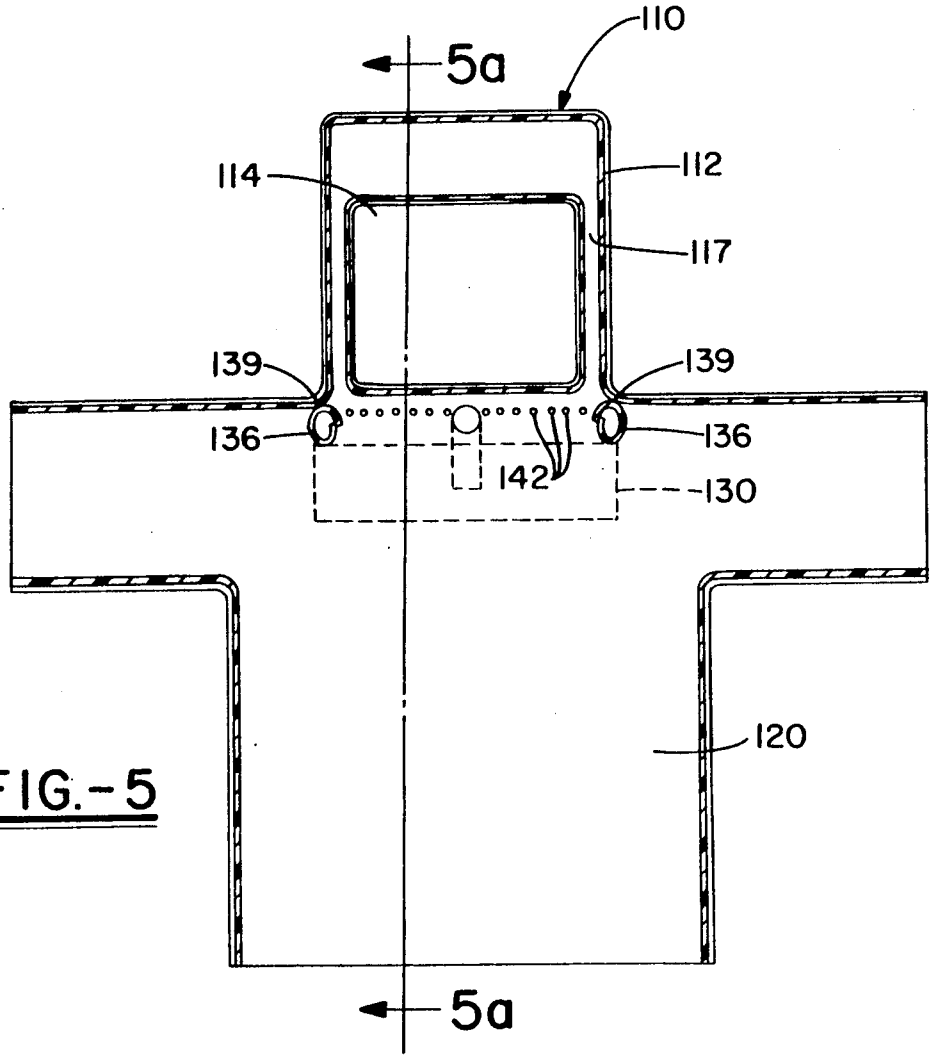
FIG. 5 is a front elevation view similar to FIG. 1 showing yet another embodiment of the protective hood.

The embodiment of FIG. 5 is generally similar to the embodiment of FIGS. 1 through 3 with the exception that it generally has longer sleeves and longer outer panels. Accordingly, the same will be briefly described with the understanding that the various technical and structural aspects thereof, if not discussed, are generally similar to FIGS. 1 to 3 and thus are hereby fully incorporated by reference.

Figure 5A:
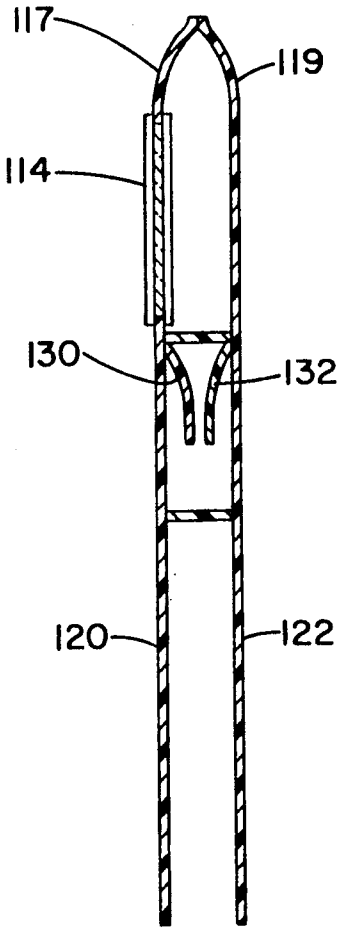
FIG. 5*a* is a side cross-section view of the hood of FIG. 5 taken on line 5*a*—5*a* thereof but does not show the collar for purposes of clarity.

In the embodiment of FIG. 5 and FIG. 5*a*, the hood 110 has a front overhead section 112 which comprises front panel 117 which can be integral with outer front flap 120. In a similar manner, back panel 119 of the overhead section is desirable integral with rear outer flap 122. Plastic visor 114 which can be made out of any suitable transparent material such as polycarbonate, can have any suitable configuration such as rectangular, oval, elliptical, and the like. The shape of the visor can be generally flat as shown in FIG. 5*b*, curvilinear as shown in FIG. 5*c*, or U-shaped as shown in FIG. 5*d*, or any other desirable shape.

The inner front and inner rear flaps 130, 132 are somewhat shorter in length than the outer flaps 120, 122, although they can be of any length. The outer flaps 120, 122 are longer and intend to cover the entire exterior of the user's clothing including the shoulder, chest and back area, down to about the top of the thigh to protect the wearer from contact with undesirable environmental materials. The inside flaps 130, 132 are adapted to be worn inside the wearer's clothing and particularly tucked inside the collar and shoulder area of the wearer's shirt or jacket. The inner flaps 130 and 132 are intended to provided additional protection against exposure to undesirable environmental compounds. The protective hood 110 further contains an inflatable collar 136 (see FIG. 5) adapted to rest on the wearer's shoulders during use. The collar 136 comprises a continuous strip of flexible fabric secured at the top to the overhead section 112 by fused seam 139. As with the previous embodiment, collar 136 can be integral with front and back interior flaps 130 and 132 having a looped configuration of the upper end thereof and attached to itself through a fused seam. Collar 136 contains a plurality of apertures 142 therein which communicates with the overhead section 112 to provide a supply of air or oxygen from a conventional source to enable the user to breath. The collar 136 is adapted to rest flat against the flaps 120, 122, 130, 132 during non-use but adapted to be inflated during use to surround the user's neck and rest on his shoulders. As apparent from FIG. 5, this embodiment contains sleeves 144 which can merely be an extension of exterior front and rear panels 117 and 119 or made of a separate material connected along one portion by a seam, not shown, and at the sleeve connected to the front and rear outer panels as through a vertical fused seam, not shown. The length of the sleeves can vary according to the desired end use.

The inflatable protective hood of the present invention can be utilized to protect an individual or user against undesirable environmental compounds such as various chemical compounds including toxic compounds, various biological compounds, various nuclear compounds or particles, various hazardous materials, or the like. The type of protective material which is utilized to form the inflatable protective hood generally depends on the end use. Whenever a barrier material is needed with respect to a fluid, a solid compound, or a gas, a laminate is generally utilized containing a suitable barrier material therein to protect against the specific undesired compound. The barrier is thus any type of material fulfilling a desired end use need such as being impervious with regard to a gas or a fluid, and the like, and can be any specific barrier material known to the literature as well as to the art. The barrier material is generally coated or covered on each side by a suitable plastic, polymer, rubber, or the like. Any type of laminate can be utilized including those containing a plurality of one or more similar or different barrier materials with one or more similar or different covering materials which can be a fabric, or a sheet or film, etc. and thus the protective material can be a laminate having two or more layers up to approximately 15, 20 or even 25. Suitable fabrics can be made from conventional polymers such as polyethylene, polypropylene, polyester, nylon, polyurethane, various types of rubber, and the like, including combinations thereof, and can be waterproof or flameproof. The barrier material can be any conventional barrier material available which is desired to be utilized against a specific type of hazardous, biological compounds, etc.

The protective material can also be a non-woven material made from suitable polymers including polyethylene, polypropylene, various polyesters, various nylons, various polyurethanes, and the like, including combinations thereof. Non-woven materials can be utilized in such situations as in "clean" rooms, the sporting industry, chemical plants, dust abatement situations, painting, and the like. A highly desirable non-woven material includes "GOR-TEX," a microporous polyethylene manufactured by DuPont, or Exxaire, manufactured by DuPont. Such materials permits vapor, such as water vapor omitted by the user, to pass outwardly through the material but prevents liquids such as water, blood, and even viruses from passing therethrough into the hood. Generally, any type of non-woven material known to the art and to the literature can be utilized such as those which function as protective breathable materials, or protective materials only, as for example chemical fluids or gases.

While in accordance with the Patent Statutes, the best mode and preferred embodiment has been set forth, the scope of the invention is not limited thereto, but rather by the scope of the attached claims.

What is claimed is:

1. A protective hood for use in protecting at least a user's head against contact with undesirable compounds, the hood comprising:

an enclosed, flexible overhead section adapted to expand over the head of the suer, said overhead section containing a front visor panel for viewing outside the hood where the visor is secured to the overhead section by a fused impervious seam with the periphery of the visor, said visor being flat and flexible, said overhead section comprising flat flexible protective material, whereby said hood may be collapsed to form a flat, substantially planar configuration;

said overhead section having at least a downwardly depending front and a rear flap;

said overhead section having an inflatable annular collar secured to said front and rear flaps, said annular collar adaptable to be inflated and maintained inflated in use, and said inflatable collar capable of being connected to an external air source to inflate said collar and where said inflated collar is adapted to rest on the user's shoulders.

2. The hood of claim 1, wherein said front and rear flaps are exterior flaps and including an interior front and rear flap, and one of said exterior or interior flaps being integral with said overhead section.

3. The protective hood of claim 2, wherein said overhead section is secured to said downwardly depending interior front and rear flaps for insertion inside the user's clothing.

4. The protective hood of claim 3, wherein said internal flaps are integral with said collar.

5. The protective hood of claim 1, wherein said inflatable annular collar contains a plurality of circumferentially spaced small air holes to permit air to egress from said inflated collar.

6. The protective hood of claim 5, wherein the air provided to the inflated collar maintains a positive air pressure inside said hood to maintain said hood inflated during use.

7. The protective hood of claim 1, wherein said hood construction contains fused impervious seams.

8. The protective hood of claim 4, wherein said hood contains fused impervious seams.

9. The protective hood of claim 5, wherein said hood contains fused impervious seams.

10. A protective hood adapted to be supported by a user's shoulders in use for protection of at least a user's head against contact with undesirable materials, the hood comprising:

an enclosed, flexible overhead section adapted to expand over the head of the user, said overhead section containing a front visor panel for viewing outside the hood where the visor is secured to the overhead section by an impervious seam at the periphery of the visor;

said overhead section having at least a downwardly depending exterior flap and interior front and rear flaps;

said overhead section having an inflatable peripheral collar secured to one of said interior front and rear flaps or to said exterior flaps, said inflatable collar adapted to be inflated and maintained inflated in use, said inflatable collar capable of being connected to an external air source to inflate said collar, and where said inflated collar is adapted to rest on the user's shoulders in use.

11. The protective hood of claim 10, comprising a flat flexible protective material construction adapted to be collapsed in non-use and readily expandable in use.

12. The hood of claim 10, wherein said inflatable collar comprises an interior neck wall containing a plurality of circumferentially spaced small air holes wherein said air holes permit air to egress from said inflated collar.

13. The hood of claim 12, wherein the air source is maintained in connection with the inflated collar in use and provides positive pressure to the inflated collar to maintain the collar inflated.

14. The hood of claim 12, wherein said plurality of air holes are laterally adjacent and circumferentially spaced.

15. The hood of claim 13, wherein said plurality of air holes are laterally adjacent and circumferentially spaced.

16. The hood of claim 10, wherein said overhead section is connected by an impervious, lateral fused seam with said front and rear interior flaps.

17. The hood of claim 12, wherein said overhead section is connected by an impervious, lateral fused seam with said front and rear exterior flaps.

18. The hood of claim 15, wherein said overhead section is connected by an impervious, lateral fused seam with said front and rear exterior flaps.

19. The hood of claim 10, wherein said overhead section comprises an exterior front panel and an exterior rear panel, each panel having peripheral side and top edges respectively secured together by an impervious, fused seam.

20. The hood of claim 19, wherein said fused seam is an electronically fused seam.

21. The protective hood of claim 10, wherein the visor is curvilinear.

22. The protective hood of claim 21, wherein the visor comprises polycarbonate.

23. The protective hood of claim 10, wherein the flexible fabric of said hood comprises a polyolefin plastic.

24. The protective hood of claim 10, wherein the inflated collar is adapted to support the weight of the hood upon the shoulders of the user.

* * * * *